US010563329B2

(12) United States Patent
Arold

(10) Patent No.: US 10,563,329 B2
(45) Date of Patent: Feb. 18, 2020

(54) BRAIDING BOBBIN AND BRAIDING DEVICE

(71) Applicant: Airbus Operations GmbH, Hamburg (DE)

(72) Inventor: Bettina Arold, Hamburg (DE)

(73) Assignee: AIRBUS OPERATIONS GMBH, Hamburg (DE)

( * ) Notice: Subject to any disclaimer, the term of this patent is extended or adjusted under 35 U.S.C. 154(b) by 434 days.

(21) Appl. No.: 15/349,574

(22) Filed: Nov. 11, 2016

(65) Prior Publication Data

US 2017/0137979 A1 May 18, 2017

(30) Foreign Application Priority Data

Nov. 13, 2015 (DE) ..... 10 2015 119 682

(51) Int. Cl.
*D04C 3/18* (2006.01)
*D04C 1/02* (2006.01)
(Continued)

(52) U.S. Cl.
CPC ..... *D04C 3/18* (2013.01); *D04C 1/02* (2013.01); *D04C 3/38* (2013.01); *D04C 3/14* (2013.01)

(58) Field of Classification Search
CPC ... D04C 1/02; D04C 3/14; D04C 3/16; D04C 3/18; D04C 3/38; B32B 38/10; Y10T 156/1195; Y10T 156/1994
(Continued)

(56) References Cited

U.S. PATENT DOCUMENTS 1,358,173 A * 11/1920 Penso ..... D04C 3/30 87/32
2,653,506 A * 9/1953 Fraser ..... D04C 3/00 87/31

(Continued)

FOREIGN PATENT DOCUMENTS

DE 102007054645 A1 5/2009
EP 2479327 A1 7/2012
EP 2905366 A1 8/2015

OTHER PUBLICATIONS

German Patent Office, German Search Report for German Patent Application No. 10 2015 119 682.4 dated Aug. 29, 2016.

(Continued)

*Primary Examiner* — Shaun R Hurley
*Assistant Examiner* — Jocelyn Bravo
(74) *Attorney, Agent, or Firm* — Lorenz & Kopf LLP

(57) ABSTRACT

The invention relates to a braiding bobbin for a braiding device. The braiding bobbin includes a cylindrical braiding spool, from which a previously wound, multilayer ribbon can be unwound, wherein a first layer of the ribbon consists of a pre-impregnated fiber film, and a second layer of the ribbon consists of a protective film. In addition, the braiding bobbin includes a bracket to which the braiding spool is frontally and rotatably fastened. Additionally provided for the braiding bobbin is a cylindrical additional spool for winding the protective film of the unwound ribbon and a deflection element. The deflection element is fastened to the bracket, wherein the deflection element is secured spaced apart in the radial direction R to the braiding spool and designed for deflecting the protective film from the braiding spool to the additional spool.

17 Claims, 3 Drawing Sheets

(51) Int. Cl.
*D04C 3/38* (2006.01)
*D04C 3/14* (2006.01)

(58) Field of Classification Search
USPC ..... 87/55, 56, 57
See application file for complete search history.

(56) References Cited

U.S. PATENT DOCUMENTS

| | | | | |
|---|---|---|---|---|
| 2,897,715 | A * | 8/1959 | Olson | D04C 3/14 87/56 |
| 4,788,898 | A * | 12/1988 | Bull | D04C 3/18 242/156.2 |
| 6,450,078 | B1 | 9/2002 | Frank et al. | |
| 2005/0056378 | A1* | 3/2005 | Schwertfeger | B65H 37/005 156/759 |
| 2007/0251647 | A1* | 11/2007 | Huang | B65C 11/00 156/577 |
| 2015/0099111 | A1* | 4/2015 | Hou | B32B 37/20 428/339 |

OTHER PUBLICATIONS

European Patent Office, European Search Report for European Patent Application No. 16 19 8635 dated Apr. 24, 2017.

* cited by examiner

BRAIDING BOBBIN AND BRAIDING DEVICE

CROSS-REFERENCE TO RELATED APPLICATION

This application claims priority of German Patent Application No. 10 2015 119 682.4, filed 13 Nov. 2015, the disclosure of which application is herewith incorporated herein by reference in its entirety.

TECHNICAL FIELD

The invention relates to a braiding bobbin for a braiding device, comprising a cylindrical braiding spool, from which a previously wound, multilayer ribbon can be unwound, wherein a first layer of the ribbon consists of a pre-impregnated fiber film, and a second layer of the ribbon consists of a protective film, and a bracket to which the braiding spool is frontally and rotatably fastened.

In addition, the invention relates to a braiding device for braiding a mandrel with a pre-impregnated fiber film, comprising a hollow cylindrical module carrier, a plurality of impellers, which are arranged one behind the other on the module carrier in the circumferential direction of the modular carrier, wherein each impeller is designed to hold a braiding bobbin and transfer the braiding bobbin to an adjacent impeller, and a plurality of braiding bobbins, which are held by the impellers and may be transferred from impeller to impeller in the circumferential direction of the module carrier.

BACKGROUND

Braiding devices are used to braid a mandrel. The mandrel may here consist of a plastic mandrel or mandrel designed in some other way. The mandrel is to be braided with a pre-impregnated fiber film, thereby yielding a fiber composite component. In order to fix the shape of the fiber composite component, the latter may be cured in a subsequent procedural step.

A hollow cylindrical module carrier is provided for the braiding device. For braiding purposes, the mandrel may be pushed through a hollow cylindrical opening of the module carrier, so that the fiber film may be braided while pushed onto the mandrel.

Also provided for the braiding device is a plurality of impellers, which are arranged on the module carrier one behind the other in the circumferential direction of the module carrier. The impellers may here be situated radially inwardly on the module carrier and/or in an axial direction frontally on the module carrier. Each impeller is used to hold a braiding bobbin. In addition, the impellers are designed to transfer a respective braiding bobbin to an adjacent impeller. Therefore, if a braiding bobbin is transferred from one impeller to the next impeller, the braiding bobbin wanders from impeller to impeller in the circumferential direction of the module carrier.

Also provided is a plurality of braiding bobbins for the braiding device, which may be held by the impellers and transferred from impeller to impeller in the circumferential direction of the module carrier. Therefore, the braiding bobbins may be distributed in the circumferential direction of the module carrier, wherein the braiding bobbins are transferred between adjacent impellers. It may here preferably be provided that the braiding bobbins be transferred in a shared circumferential direction of the module carrier. In this way, the plurality of braiding bobbins wanders in the circumferential direction of the module carrier. It may also be provided that the impellers be designed to transfer the braiding bobbins from impeller to impeller through rotation. This enables a braiding of pre-impregnated fiber films, wherein a respective one of them from a respective one of the braiding bobbins is wound on beforehand, and may be unwound with the rotation of the braiding bobbins, so as to braid the mandrel.

It has been found of advantage for braiding a mandrel to use a pre-impregnated fiber film. For example, this may be a so-called prepreg material or some other semi-finished product with fibers impregnated by a resin. The fibers of the fiber films are carbon fibers and/or glass fibers and/or aramid fibers, for example. A resin based on epoxides and/or a vinyl ester may be provided for impregnation. The pre-impregnated fiber film may comprise an exterior adhesiveness. In particular, the pre-impregnated fiber film may be at least partially uncured and/or be designed as a semi-finished product. For example, the pre-impregnated fiber film may comprise a resin, which may be configured to automatically adhere to other materials.

In order to prevent the pre-impregnated fiber film from becoming cured already before the mandrel is braided and/or to prevent the windings of the pre-impregnated fiber film on the braiding spool from adhering to each other, it is provided that the fiber film may be or is wound on the cylindrical braiding spool as a layer of the multilayer ribbon. Another layer of the multilayer ribbon is comprised of a protective film. The protective film is here preferably designed in such a way that the pre-impregnated fiber film only comprises a slight adhesive effect relative to the protective film. In particular, the adhesive effect between the fiber film and protective film is less than a dimensional stability of the pre-impregnated fiber film. As a consequence, the protective film may be designed in such a way that the pre-impregnated fiber film may be non-destructively peeled from the protective film.

Also provided for the braiding bobbin is a bracket, to which the braiding spool is frontally and rotatably fastened. The braiding spool may thus be rotatably fastened to the bracket with a front side allocated thereto. This allows the braiding spool to rotate around an accompanying longitudinal axis relative to the bracket.

Known from publication EP 2 905 366 A1 is a braiding device along with a braiding bobbin.

During the practical application of a braiding bobbin on which a multilayer ribbon is wound, wherein a first layer of the ribbon consists of a pre-impregnated fiber film and a second layer of the ribbon consists of a protective film, it was determined that careless operation could result in the problem of the protective film getting into the area of the mandrel, where the protective film is then braided together with the pre-impregnated fiber film in an undefined manner on the mandrel. However, the protective film is not used to form the fiber composite component.

BRIEF SUMMARY

Therefore, the object of the invention is to propose a braiding bobbin and a braiding device that prevent the protective film from being braided onto the mandrel along with the pre-impregnated fiber film.

According to a first aspect of the invention, the aforementioned object is solved with a braiding bobbin having the features such as a braiding bobbin for a braiding device, comprising: A cylindrical braiding spool, from which a previously wound, multilayer ribbon may be unwound, wherein a first layer of the ribbon consists of a pre-impregnated fiber film and a second layer of the ribbon consists of a protective film, a bracket to which the braiding spool is frontally and rotatably fastened, a cylindrical additional spool for winding the protective film of the unwound ribbon, and a deflection element fastened to the bracket, wherein the deflection element is secured spaced apart in the radial direction to the braiding spool and designed for deflecting the protective film from the braiding spool to the additional spool.

The advantage to the braiding bobbin owing to the additional spool and deflection element is that the protective film may be directly wound again by the braiding bobbin or additional spool while unwinding the multilayer ribbon. As a result, the braiding bobbin with the additional spool and deflection element ensures that the protective film may be kept away from a mandrel to be braided with the pre-impregnated fiber film, which is also unwound while unwinding the multilayer ribbon. To this end, the protective film may be guided and/or directed toward the additional spool over a side of the deflection element facing away from the braiding spool, so that a separation may be created between the pre-impregnated fiber film and protective film while unwinding the multilayer ribbon, wherein the pre-impregnated fiber film may be guided to the mandrel to braid the latter, and wherein the protective film may be directed by the deflection element to the additional spool. This separation of the protective film from the pre-impregnated fiber film in (especially direct) proximity to the braiding spool and/or additional spool makes it possible to guide the pre-impregnated fiber film for braiding the mandrel free of the protective film while unwinding the multilayer ribbon.

The braiding spool and/or additional spool are preferably designed as cylindrical bodies. Such a body may comprise a cylindrical jacket wall, onto which the multilayer ribbon or protective film may be wound. The term "cylindrical" is preferably not limited to a circular-cylindrical shape. For example, the braiding spool and/or additional spool may have a circular, oval, or polygonal cross section, and/or some other annular shape. In addition, the braiding spool and/or additional spool may comprise a constant diameter in the axial direction, or a varying diameter in the axial direction. For example, the braiding spool and/or additional spool may comprise a straight outer contour or curved outer contour in a longitudinal section. In particular, the braiding spool and/or additional spool may be conical in design.

In an example, the pre-impregnated fiber film may be designed as a pre-impregnated fiber-band, a pre-impregnated fiber tape or a pre-impregnated fiber-ribbon.

The bracket is preferably designed to have the braiding spool rotatably mounted thereto. In addition, the deflection element is fastened to the bracket. The deflection element is preferably rigidly joined with the bracket. In this way, the deflection element and bracket may be configured as an integral component. In addition, it may be provided that the bracket be designed as a base plate.

One advantageous embodiment of the braiding bobbin is characterized in that the additional spool is coupled to the braiding spool in such a way that a rotation by the braiding spool around an accompanying braiding spool rotational axis causes the additional spool to rotate around an accompanying additional spool rotational axis. Coupling the additional spool to the braiding spool ensures that the additional spool may be driven around the accompanying additional spool rotational axis. The coupling may here be designed as a mechanical coupling.

Braiding a mandrel allows a tensile force to act on the pre-impregnated fiber film in the direction of the mandrel. The latter makes it possible to initiate an unwinding of the multilayer ribbon from the braiding spool, thereby causing the braiding spool to rotate around the accompanying braiding spool rotational axis. In other words, braiding the mandrel makes it possible to remove or unwind the pre-impregnated fiber film from the braiding spool. This triggers the aforementioned rotation by the braiding spool around the accompanying braiding spool rotational axis. Due to the preferred coupling between the braiding spool and additional spool, the additional spool may be made to rotate around the accompanying rotational spool rotational axis, thereby causing the protective film to be wound. Therefore, coupling the additional spool to the braiding spool may ensure that the additional spool is always made to rotate around the accompanying additional spool rotational axis if the braiding spool also rotates around the accompanying braiding spool rotational axis. In this way, the protective film is effectively kept away from the mandrel, which prevents the mandrel from also being inadvertently co-braided by the protective film.

A preferred embodiment of the braiding bobbin is characterized in that the braiding spool and additional spool are arranged one behind the other in an axial direction of the braiding spool. This configuration of the braiding bobbin offers the advantage that the braiding bobbin may comprise an especially small surface area. As a result, an especially high number of braiding bobbins may be held by the impellers or transferred from impeller to impeller in the circumferential direction of a modular carrier of the braiding device.

It has been found of advantageous for a front side of the braiding spool to be situated parallel opposite a front side of the additional spool. Such a configuration enables an especially compact structural design for the braiding bobbin.

Another advantageous embodiment of the braiding bobbin is characterized in that a first front side of the braiding spool is joined with a first front side of the additional spool. Such a configuration of the braiding bobbin is especially compact. The first front side of the braiding spool may be materially, non-positively (force fit) and/or positively (form fit) joined with the first front side of the additional spool. The first front side of the braiding spool and the first front side of the additional spool may here be front sides facing each other.

In another example, it may be provided that the braiding spool and the additional spool have an integral and/or one-piece design. Such an embodiment of the braiding bobbin is also especially compact, and may comprise a high dimensional stability.

Another advantageous embodiment of the braiding bobbin is characterized in that the first front side of the braiding spool is separate from the first front side of the additional spool. This embodiment of the braiding bobbin makes it possible to change out the respective braiding spool and/or additional spool decoupled from each other. In addition, such an embodiment allows the braiding spool and additional spool to rotate in different directions.

Another advantageous embodiment of the braiding bobbin is characterized in that the braiding spool and additional spool are aligned coaxially or with axial directions aligned parallel to each other. The axial direction of the braiding spool may be determined by the accompanying braiding spool rotational axis. The axial direction of the additional spool may be determined by the accompanying additional spool rotational axis.

The additional spool rotational axis of the additional spool may be spaced apart in a radial direction from the braiding spool rotational axis of the braiding spool. The two rotational axes may here be aligned parallel to each other.

Given a coaxial alignment of the additional spool to the braiding spool, the latter may comprise a shared rotational axis.

Another example may provide that the braiding spool and additional spool be situated at an angle deviating from 0° relative to each other. For example, it may be provided that the additional spool rotational axis of the additional spool be arranged at an angle of between 30° and 120°, preferably of 90°, relative to the braiding spool rotational axis of the braiding spool.

Another advantageous embodiment of the braiding bobbin is characterized in that the additional spool is coupled with the braiding spool by at least one driving means, so that rotating the braiding spool around the accompanying braiding spool rotational axis by means of the at least one driving means causes the additional spool to rotate around the accompanying additional spool rotational axis. This embodiment of the braiding bobbin offers the advantage that the additional spool may be driven by the braiding spool, so that a rotation of the braiding spool causes a rotation of the additional spool.

For example, a transmission may be provided as the driving means. The transmission may comprise a transmission ratio of 1, a transmission ratio of less than 1 or a transmission ratio of greater than 1. The transmission offers the advantage that a ratio between the rotational speed of the braiding spool and a rotational speed of the additional spool may be determined or set. For example, if the additional spool comprises a smaller diameter than the braiding spool, the transmission may be designed in such a way that a rotation of the braiding spool at a specific rotational speed leads to a rotation of the additional spool at a higher rotational speed.

The or one of the driving means may also be comprised of a sliding clutch. The sliding clutch offers the advantage that a protective film that has been unwound but not yet wound onto the additional spool will not tear. For example, if a high tensile stress acts on the protective film, the sliding clutch may slip through, so that the sliding clutch may be used to limit the tensile stress on the protective film.

A belt drive may be provided as the or one driving means. As a result of the belt drive, the additional spool need not be situated coaxially to the braiding spool. In addition, the or one of the driving means may be especially simple in design using a belt drive.

Another advantageous embodiment of the braiding bobbin is characterized in that each front side of the braiding spool comprises a radially outwardly protruding braiding spool limiting disk. The braiding spool limiting disks may ensure a reliable winding and/or unwinding of the multilayer ribbon onto or from the braiding spool, respectively.

Another advantageous embodiment of the braiding bobbin is characterized in that each front side of the additional spool comprises a radially outwardly protruding additional spool limiting disk. The additional spool limiting disks may ensure a reliable winding of the protective film onto the additional spool.

If the braiding spool and additional spool are designed as an integral component, a braiding spool limiting disk may be designed integrally with an additional spool limiting disk.

Another advantageous embodiment of the braiding bobbin is characterized in that the deflection element extends in an axial direction from a first deflection element end to a second deflection element end, wherein the first deflection element end is situated radially outside relative to the braiding spool, and the second deflection element end is situated radially outside relative to the additional spool. In this embodiment, the axial direction preferably refers to the axial direction of the braiding spool, which is preferably determined by the braiding spool rotational axis.

The deflection element is preferably situated radially outside, in particular parallel, and/or overlapping relative to the braiding spool and additional spool.

An example may provide that the second deflection element end be arranged radially outside relative to a section of the additional spool that is central in the axial direction. This makes it possible for the deflection element to not extend in an axial direction over the entire length of the braiding bobbin and/or additional spool.

Because the deflection element may extend from a radially outer area of the braiding spool to a radially outer area of the additional spool, the deflection element may especially reliably divert the protective film from the braiding spool to the additional spool.

The deflection element may preferably be designed as a rod-shaped body. The rod-shaped body may be fastened at one end to the bracket and/or extend parallel to the braiding spool rotational axis and/or the additional spool rotational axis.

Another example may provide that the deflection element be formed by an annular body, in particular having an oval and/or circular opening cross section. The protective film may be guided through the opening of such an annular body, so as to ensure a reliable diversion from the braiding spool to the additional spool using such a deflection element.

Another advantageous embodiment of the braiding bobbin is characterized in that the deflection element comprises a first guiding element protruding in the radial direction for guiding the protective film. The first guiding element of the deflection element offers the advantage that a guiding path for the protective film may be more precisely determined. In an example, the first guiding element may be designed as a deflection pin or deflection roller.

Another advantageous embodiment of the braiding bobbin is characterized in that the first guiding element is situated centrally in an axial direction relative to the braiding spool. Such an arrangement of the first guiding element makes it possible to deflect the protective film in direct proximity to the braiding spool at the first guiding element, so as to be guided away from the braiding spool. This may provide a stronger guarantee that the protective film will not inadvertently be guided to the mandrel.

Another advantageous embodiment of the braiding bobbin is characterized in that the deflection element comprises a second guiding element protruding in the radial direction for guiding the protective film.

The second protruding guiding element may be used to determine a guiding section along which the protective film is to be guided from the braiding spool to the additional spool. In an example, the second guiding element may be designed as a deflection pin or a deflection roller.

Another advantageous embodiment of the braiding bobbin is characterized in that the second guiding element is situated centrally in the axial direction relative to the additional spool. This arrangement of the second guiding element offers the advantage that the protective film may be specifically directed toward the additional spool.

According to another aspect of the invention, the object mentioned at the outset may be achieved by a braiding device for braiding a mandrel with a pre-impregnated fiber film, comprising a hollow cylindrical module carrier, a plurality of impellers, which are arranged one behind the other on the module carrier in the circumferential direction of the modular carrier, wherein each impeller is designed to hold a braiding bobbin and transfer the braiding bobbin to an adjacent impeller, and a plurality of braiding bobbins according to the invention, which are held by the impellers and may be transferred from impeller to impeller in the circumferential direction of the module carrier. The braiding bobbins may here preferably be designed based on one of the aforementioned advantageous embodiments or examples. For this reason, the advantages, advantageous embodiments and/or examples discussed for the braiding bobbin apply analogously to the braiding device.

A preferred embodiment of the braiding device is characterized in that each impeller comprises a motorized impeller rotatably mounted to the module carrier, with a jacket-side receiving area for receiving, holding and dispensing one of the braiding bobbins.

BRIEF DESCRIPTION OF THE DRAWINGS

Additional advantageous embodiments of the invention may be gleaned from the description of embodiments according to the invention in conjunction with the claims and/or attached drawings. Embodiments according to the invention may here involve individual features or a combination of several features. The invention will be explained below based on exemplary embodiments with reference to the drawings, without limiting the overall inventive idea. The drawings show:

DETAILED DESCRIPTION

Figure 1:
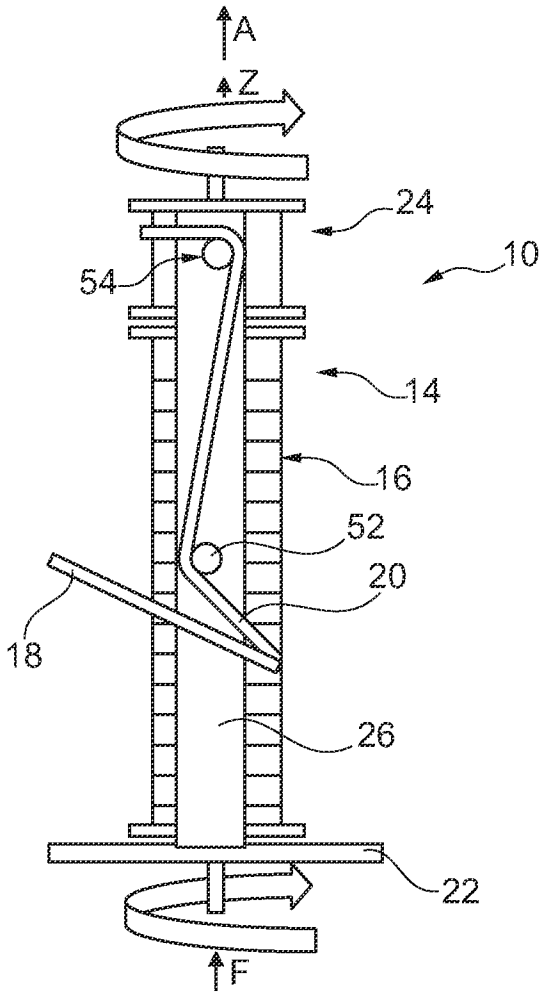
FIG. 1 depicts an exemplary embodiment of the braiding bobbin according to the invention in a first schematic side view.

FIG. 1 shows the braiding bobbin 10 according to the invention in an exemplary embodiment. The braiding bobbin 10 serves as a braiding bobbin 10 for a braiding device 12, as exemplarily shown on FIG. 5.

The braiding bobbin 10 comprises a cylindrical braiding spool 14. A multilayer ribbon 16 may be wound onto the braiding spool 14. In addition, the multilayer ribbon 16 may be unwound from the braiding spool 14. A first layer of the multilayer ribbon 16 is formed by a pre-impregnated fiber film 18. A second layer of the multilayer ribbon 16 is formed by a protective film 20.

The braiding bobbin 10 also comprises a bracket 22. The braiding spool 14 is frontally and rotatably fastened to the bracket 22.

In addition, the braiding bobbin 10 comprises a cylindrical additional spool 24 for winding the protective film 20. Therefore, the additional spool 24 is used to wind the protective film 20 of the unwound ribbon 16.

In addition, the braiding bobbin 10 comprises a deflection element 26, wherein the deflection element 26 is fastened to the bracket 22. The deflection element 26 is fastened spaced apart relative to the braiding spool 14 in the radial direction R, e.g., as shown on FIG. 2. In addition, the deflection element 26 is designed to deflect the protective film 20 from the braiding spool 14 to the additional spool 24.

As may be gleaned from FIG. 1, the bracket 22 may be designed as a base plate and/or base element. A bearing may be provided between the bracket 22 and braiding spool 14 in order to rotatably fasten the braiding spool 14 to the bracket 22. As a consequence, the braiding spool 14 may perform a rotation around an accompanying braiding spool rotational axis F relative to the bracket 22.

The braiding spool 14 is preferably designed symmetrically to the braiding spool rotational axis F. Therefore, the braiding spool 14 may be designed as a cylindrical body, in particular as a circularly cylindrical body. However, the term "cylindrical" is not to be limited to a circularly cylindrical design of the braiding spool 14. Rather, the braiding spool 14 may comprise an annular cross sectional configuration.

The multilayer ribbon 16 may be wound onto the braiding spool 14. The multilayer ribbon 16 may comprise an upper layer and a lower layer, wherein one of the two layers may be the pre-impregnated fiber film 18, and the other layer may be the protective film 20. Additional layers may be provided for the multilayer ribbon 16.

If a tensile force acts on an outer end of the ribbon 16, the latter may be unwound from the braiding spool 14. The tensile force here preferably acts on the pre-impregnated fiber film 18. The tensile force is caused by the braiding device 12 shown on FIG. 5, wherein the pre-impregnated fiber film 18 is braided onto the mandrel to be braided 28.

The tensile force acting on the pre-impregnated fiber film 18 causes the multilayer fiber ribbon 16 to unwind, so that the protective film 20 is also unwound. The pre-impregnated fiber film 18 unwound from the braiding spool 14 is guided to the mandrel 28, so as to there braid the mandrel 28, with the protective film 20 not being used to braid the mandrel 28. The purpose of the protective film 20 is to ensure that the windings of the pre-impregnated fiber film 18, if still wound onto the braiding spool 14 with the multilayer ribbon 16, only come into contact with each other slightly, or not at all. This is because the pre-impregnated fiber film 18 preferably has a "sticky" surface. Therefore, the protective film 20 is used to prevent the windings of the pre-impregnated fiber film 18, if situated on the braiding spool 14 as the result of the wound ribbon 16, from sticking together. The protective film 20 is preferably formed of a thin layer film. The protective film 20 is further preferably made out of plastic. In addition, the protective film 20 comprises such a low surface roughness that the fiber film 18 may be separated and/or peeled from the protective film 20 in essentially a nondestructive manner.

As already mentioned, the protective film 20 is not used to braid the mandrel 28. In order to keep the protective film 20 from inadvertently getting in direct proximity to the mandrel 28, and to further keep the protective film 20 from inadvertently also being braided onto the mandrel, the braiding bobbin 10 comprises a cylindrical additional spool 24. The additional spool 24 is used to wind the protective film 20, here specifically as the portion of the multilayer ribbon 16 that is unwound.

Figure 2:
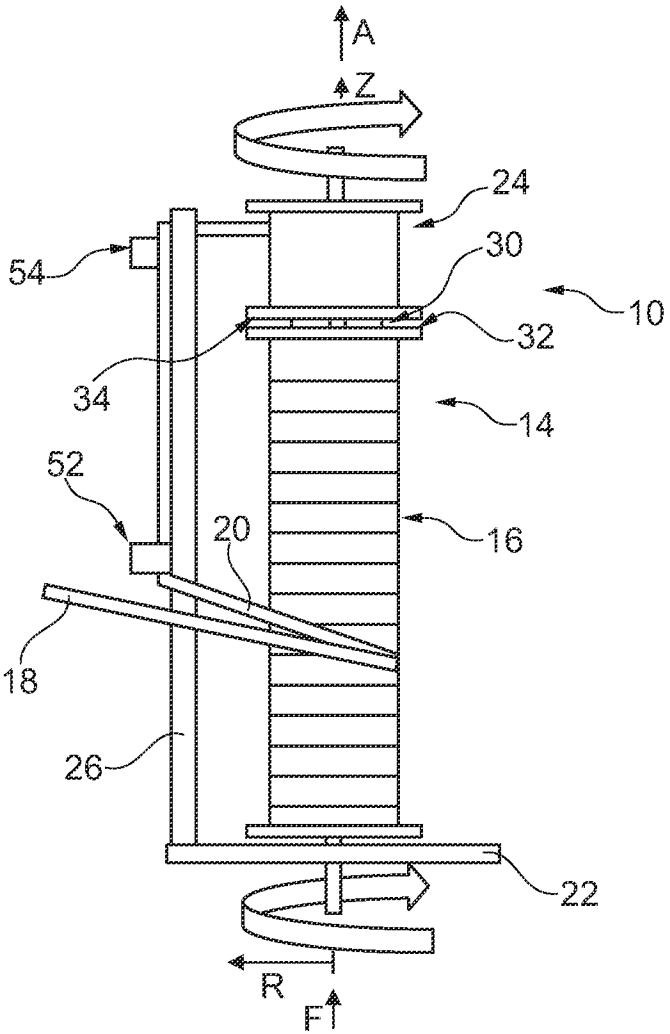
FIG. 2 depicts another exemplary embodiment of the braiding bobbin according to the invention in a schematic side view.

As may be gleaned from FIG. 1 and FIG. 2, it is preferably provided that the braiding spool 14 and additional spool 24 be arranged one behind the other in an axial direction A of the braiding spool 14. In this way, the braiding spool 14 and additional spool 24 may be aligned coaxially relative to each other. They may thus comprise a shared axial alignment. The braiding spool rotational axis F of the braiding spool 14 and an additional spool rotational axis Z of the additional spool 24 are especially preferably aligned coaxially relative to each other.

If the multilayer ribbon 16 is unwound in response to the tensile force acting on the pre-impregnated fiber film 18, the protective film 20 also thereby unwound is deflected toward the additional spool 24 by means of the deflection element 26. One end of the deflection element 26 is fastened to the bracket 22. The deflection element 26 is preferably designed as a rod-shaped body. The deflection element 26 is spaced apart in the radial direction R from the braiding spool 14 and/or additional spool 24. In addition, the deflection element 26 extends in axial direction A from the bracket 22 up to an area parallel to the additional spool 24. During deflection, the protective film 20 is directed from the braiding spool 14 to the additional spool 24 over an area of the deflection element 26 facing away from the braiding spool 14 and/or additional spool 24.

The unwound protective film 20 that was deflected by the deflection element 26 is wound by the additional spool 24. To this end, it is preferably provided that the additional spool 24 be coupled to the braiding spool 14 in such a way that a rotation by the braiding spool 14 around the accompanying braiding spool rotational axis F triggers a rotation by the additional spool 24 around the accompanying additional spool rotational axis Z. For example, if the braiding spool 14 rotates clockwise around the accompanying braiding spool rotational axis F, as schematically denoted on FIG. 1 by the rotation arrow below the bracket 22, the additional spool 24 may resultantly also rotate clockwise around the accompanying additional spool rotational axis Z, as denoted by the rotation arrow above the additional spool 24. A rotation by the braiding spool 14 may basically also lead to an opposite rotation by the additional spool 24.

An exemplary coupling of the additional spool 24 to the braiding spool 14 is schematically shown on FIG. 2. For example, coupling may be accomplished by means of a connecting element 30, which extends from a front side 32 of the braiding spool 14 to an oppositely situated front side 34 of the additional spool 24. The at least one connecting element 30 may be used to establish a mechanical coupling between the braiding spool 14 and additional spool 24. If the braiding spool 14 is now made to rotate by the tensile force acting on the fiber film 18, the braiding spool 14 simultaneously drives the additional spool 24. This configuration ensures that the protective film 20 will always be wound up when the multilayer ribbon 16 or pre-impregnated fiber film 18 starts to be unwound.

Another advantageous embodiment of the braiding bobbin 10 is characterized in that the front side 32 of the braiding spool 14 is connected with the front side 34 of the additional spool 24, in particular directly. For example, the front side 32 of the braiding spool 14 may be joined with the front side 34 of the additional spool 24 materially, non-positively (force fit) and/or positively (form fit). It may further be preferred that the braiding spool 14 and additional spool 24 have an integral and/or one-piece design.

Figure 3:
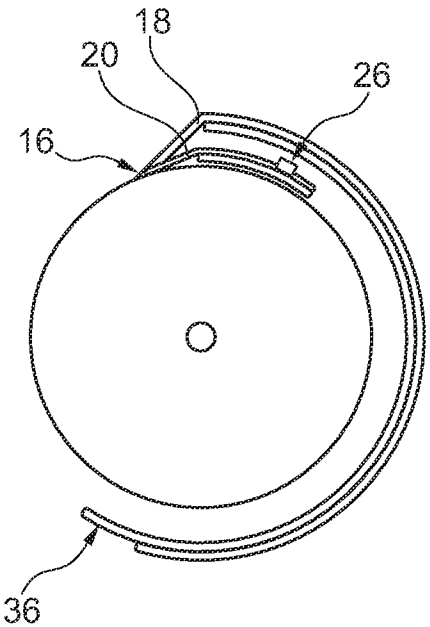
FIG. 3 depicts another exemplary embodiment of the braiding bobbin according to the invention in a schematic top view.

FIG. 3 presents a side view along a transverse axis of the braiding bobbin 10. As may be taken therefrom, the protective film 20 is guided by the deflection element 26 while unwinding the multilayer ribbon 16. The fiber film 18 also unwound while unwinding the multilayer ribbon 16 is guided away from the braiding spool 14 by a fiber guiding element 36, in particular partially toward the mandrel. The fiber guiding element 36 is situated radially outside relative to the deflection element 26. The deflection element 26 is also depicted on FIG. 3. The latter also directs the protective film 20 away from the braiding spool 14 while peeling off the multilayer ribbon 16, so as to divert it toward the additional spool 24.

Figure 4:
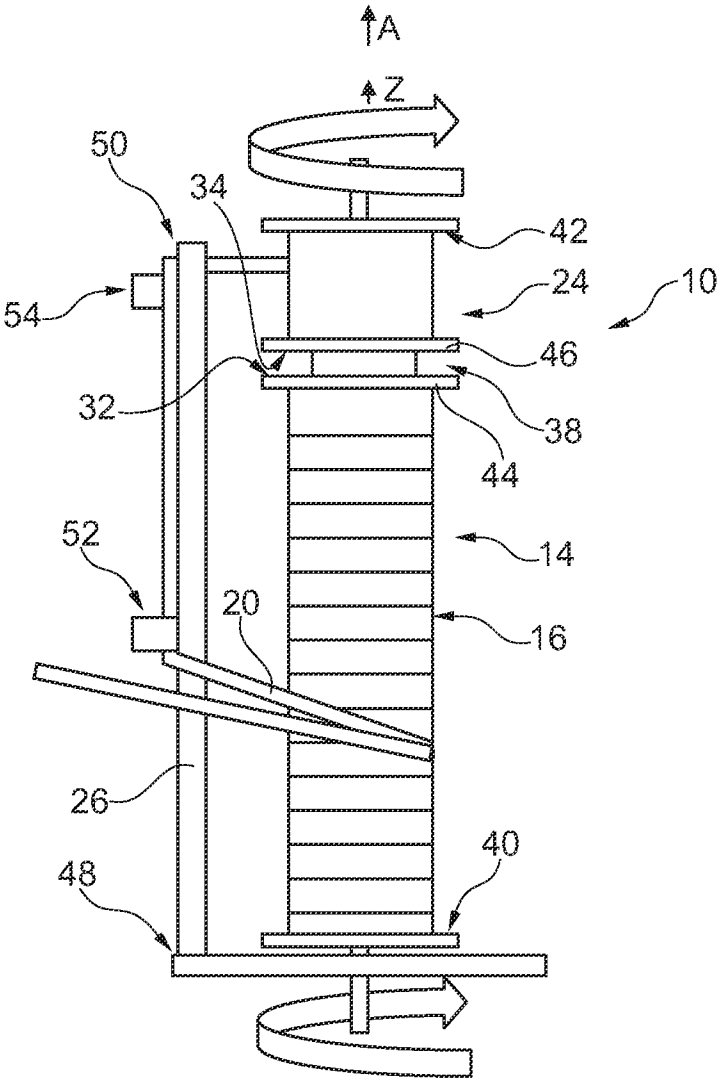
FIG. 4 depicts another exemplary embodiment of the braiding bobbin according to the invention in a schematic side view.

Another embodiment of the braiding bobbin 10 is shown on FIG. 4. The braiding bobbin 10 here comprises a driving means 38. The additional spool 24 is coupled with the braiding spool 14 by means of the at least one driving means 38, which is only schematically shown on FIG. 4, so that a rotation by the braiding spool 14 around the accompanying braiding spool rotational axis F by means of the at least one driving means 38 causes the additional spool 24 to rotate around the accompanying additional spool rotational axis Z. For example, the driving means 38 may be a simple transmission. By means of the transmission the braiding spool 14 may be driven by the additional spool 24. If the braiding spool 14 is made to rotate, the transmission also causes the additional spool 24 to rotate. The rotational directions may correspond to each other or be opposite each other.

Alternatively or additionally, a driving means may be designed as a sliding clutch. The sliding clutch offers the advantage of being able to limit a tensile force on the protective film 20, which may be exerted by the additional spool 24 on the protective film 20. As a result, a tearing of the protective film 20 may be effectively prevented.

The braiding spool 14 may comprise a radially outwardly protruding braiding spool limiting disk 44 on one or all of its front sides 32 or 40. The at least one braiding spool limiting disk 44 may ensure a reliable unwinding of the multilayer ribbon 16 or the fiber film 18 and the protective film 20, respectively.

The additional spool 24 may comprise a radially outwardly protruding additional spool limiting disk 46 on at least one or each of its front faces 34, 42. The at least one frontal additional spool limiting disk 46 may ensure that the protective film 20 is reliably wound onto the additional spool 24.

It may also be provided for the braiding bobbin 10 that the deflection element 26 extend in an axial direction A from a first deflection element end 48 to a second deflection element end 50, wherein the first deflection element 48 is situated radially outside relative to the braiding spool 14 or on the bracket 22, and the second deflection element end 50 is situated radially outside relative to the additional spool 24. It is here possible that the deflection element 26 not extend over the entire length of the braiding bobbin 10. For example, the deflection element 26 may extend in an axial direction up to an outer third of the additional spool 24 facing away from the braiding spool 14.

As may be taken from FIGS. 1, 2 and 4, the deflection element 26 may comprise at least one first guiding element 52 and/or at least one additional, in particular the second, guiding element 54. The first and/or second guiding element 52, 54 may be formed and/or fastened to an in particular rod-shaped base body of the deflection element 26. The deflection element 26 preferably comprises the first guiding element 52 protruding in a radial direction for guiding the protective film 20. As a consequence, the first guiding element 52 may absorb forces caused from the protective film 20 in the axial direction A. For example, the first guiding element 52 is designed as a deflection pin or deflection roller. In addition, the deflection element 26 may comprise the second guiding element 54 protruding in a radial direction R for guiding the protective film 20. Protruding in the radial direction R may mean that the corresponding guiding element 52, 54 protrudes over a base element of the deflection element 26 in a radial direction R. The second guiding element 54 may also be designed as a deflection pin or deflection roller. Therefore, the second guiding element 54 may also absorb forces in the axial direction A. The first guiding element 52 and/or the second guiding element 54 may thus be designed to deflect the protective film 20 from a direction of movement in the radial direction R or inclined thereto into an axial direction A or inclined thereto, or vice versa. The first guiding element 52 and/or second guiding element 54 may ensure a reliable deflection of the protective film 20 from the braiding spool 14 to the additional spool 24. This is because a deflection element 26 that comprises the first guiding element 52 and/or the second guiding element 54 may reliably guide the protective film 20 from an area of the braiding spool 14 into an area of the additional spool 24.

It has been found of especially advantage for the first guiding element 52 to be situated in the axial direction centrally and/or relative to a central section of the braiding spool 14. In addition, it has been found of advantage for the second guiding element 54 to be situated in the axial direction A centrally or relative to a central section of the additional spool 24. In this case, the protective film 20 may be deflected without a too high tensile stress causing from the braiding spool 14, so that the protective film 20 may be directed or guided to the second guiding element 54 or directly to the additional spool 24. Arranging the second guiding element 54 in an axial direction A centrally or relative to a central section of the additional spool 24 has been found of advantage, since the protective film 20 may be wound onto the additional spool 24 without a too high stress.

Figure 5:
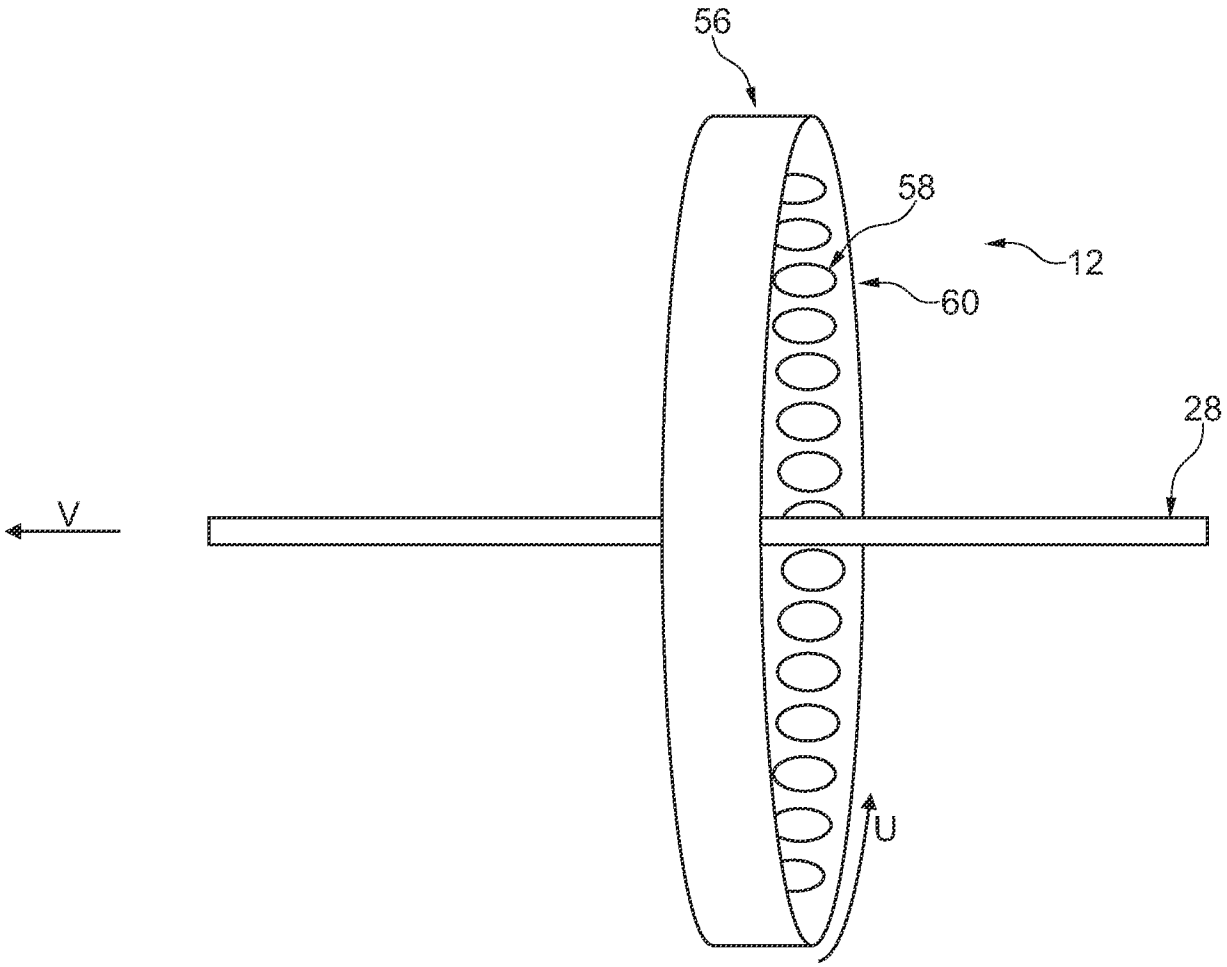
FIG. 5 depicts an exemplary embodiment of the braiding device according to the invention in a schematic perspective view.

A braiding device 12 may be gleaned at least partially and schematically from FIG. 5. The braiding device 12 is used for braiding the mandrel 28 with the pre-impregnated fiber film 18. The braiding device 12 comprises a hollow cylindrical module carrier 56. A plurality of impellers 58 shown in a simplified manner as circular elements are here provided, which are situated one behind the other on the module carrier 56 in the circumferential direction U of the module carrier 56, wherein each impeller 58 is designed to hold a braiding bobbin 10 and transfer the braiding bobbin 10 to an adjacent impeller 58. Also provided for the braiding device 12 is a plurality of braiding bobbins 10 according to the invention. The braiding bobbins 10 may be held by the impellers 58 and transferred from impeller to impeller in the circumferential direction U of the module carrier 56. The impellers 58 are preferably arranged on the jacket interior. Alternatively or additionally, the impellers may also be situated axially outside on the module carrier 56.

By transferring the braiding bobbins 10 from impeller to impeller, the respective fiber films 18 from the accompanying braiding spools 14 may be braided onto the mandrel 28, wherein the mandrel 28 is transported through the hollow cylindrical opening 60 in the feeding direction V. In the process, the fiber films 18 intersect each other on the surface of the mandrel 28, so that the latter is braided with pre-impregnated fiber film 18.

It is preferably provided for the braiding device 12 that each impeller 58 comprise a motorized impeller 58 rotatably mounted to the module carrier 56, with a jacket-side area for receiving, holding and dispensing one of the braiding bobbins 10.

The invention claimed is:

1. A braiding bobbin for a braiding device, the braiding bobbin comprising:

a multilayer ribbon including a first layer of a pre-impregnated fiber film and a second layer of a protective film, a cylindrical braiding spool on which the multilayer ribbon is initially wound, a bracket to which the braiding spool is rotatably fastened, a cylindrical additional spool configured for winding the protective film of the multilayer ribbon when the multilayer ribbon is unwound, and a deflection element fastened to the bracket, wherein the deflection element is secured at a distance in a radial direction to the braiding spool and is configured to deflect the protective film from the braiding spool to the additional spool, wherein rotation of the braiding spool to unwind the multilayer ribbon therefrom causes rotation of the additional spool to wind the protective film thereto.

2. The braiding bobbin according to claim 1, wherein the braiding spool rotates about a braiding spool axis, terminates at a lowermost end, and terminates at an uppermost end distanced from the lowermost end by a height of the braiding spool along the braiding spool axis, wherein a lowermost plane perpendicular to the braiding spool axis includes the lowermost end, wherein an uppermost plane perpendicular to the braiding spool axis includes the uppermost end, and wherein the additional spool is not located between the lowermost plane and the uppermost plane.

3. The braiding bobbin according to claim 1, wherein the braiding spool and additional spool are coaxial.

4. The braiding bobbin according to claim 1, wherein an upper end of the braiding spool is directly joined with a lower end of the additional spool.

5. The braiding bobbin according to claim 1, wherein the braiding spool and additional spool are aligned coaxially about a coaxial axis or with respective axes aligned parallel to each other, and wherein the braiding spool and additional spool are distanced from one another along the coaxial axis or in the axial direction defined by the respective axes.

6. The braiding bobbin according to claim 1, wherein the additional spool is coupled with the braiding spool by at least one driving means, wherein rotating the braiding spool around the accompanying braiding spool rotational axis by means of the at least one driving means to unwind the multilayer ribbon therefrom causes the additional spool to rotate around an accompanying additional spool rotational axis to wind the protective film thereto.

7. The braiding bobbin according to claim 1, wherein:

an end of the braiding spool comprises a radially outwardly protruding braiding spool limiting disk, and/or an end of the additional spool comprises a radially outwardly protruding additional spool limiting disk.

8. The braiding bobbin according to claim 7, wherein the deflection element extends in an axial direction from a first deflection element end to a second deflection element end, wherein the first deflection element end is situated radially outside relative to the braiding spool, the second deflection element end is situated radially outside relative to the additional spool, wherein the multilayer ribbon extends in a plane tangential to the braiding spool from the braiding spool to the first deflection element, wherein the protective film extends in a plane parallel the axis of the braiding spool from the first deflection element to the second deflection element, and wherein the protective film extends in a plane tangential to the additional spool from the second deflection element to the additional spool.

9. The braiding bobbin according to claim 8, wherein the deflection element comprises a first guiding element protruding in the radial direction for guiding the protective film.

10. The braiding bobbin according to claim 9, wherein the deflection element comprises a second guiding element protruding in the radial direction for guiding the protective film.

11. The braiding bobbin according to claim 9, wherein the braiding spool rotates about a braiding spool axis, terminates at a lowermost end, and terminates at an uppermost end distanced from the lowermost end by a height of the braiding spool along the braiding spool axis, wherein a lowermost plane perpendicular to the braiding spool axis includes the lowermost end, wherein an uppermost plane perpendicular to the braiding spool axis includes the uppermost end, and wherein the first guiding element is situated between the lowermost plane and the uppermost plane, and wherein the second guiding element is situated such that the uppermost plane is between the second guiding element and the lowermost plane.

12. A braiding bobbin for a braiding device, the braiding bobbin comprising:

a cylindrical braiding spool configured to rotate about a braiding spool axis and configured to hold a winding of a multilayer ribbon between a lowermost end and an uppermost end of the braiding spool, wherein the braiding spool axis defines an axial direction;

a bracket to which the braiding spool is rotatably fastened;

a cylindrical additional spool distanced from the braiding spool in the axial direction and configured to wind up a film layer from the multilayer ribbon when the multilayer ribbon is unwound, wherein the additional spool rotates about the braiding spool axis; and a deflection element fastened to the bracket and positioned at a distance from the braiding spool in a radial direction, wherein the deflection element is configured to deflect the film layer from the braiding spool to the additional spool.

13. The braiding bobbin according to claim 12 wherein the additional spool is directly connected to the braiding spool.

14. The braiding bobbin according to claim 12 wherein:

the deflection element extends in an axial direction from a first deflection element end to a second deflection element end;

the first deflection element end is situated radially outward from the braiding spool; and the second deflection element end is situated radially outward from the additional spool.

15. A braiding bobbin for a braiding device, the braiding bobbin comprising:

a cylindrical braiding spool configured to rotate about a braiding spool axis and configured to hold a winding of a multilayer ribbon;

a bracket to which the braiding spool is rotatably fastened;

a cylindrical additional spool configured to rotate about the braiding spool axis to wind up a film layer from the multilayer ribbon when the multilayer ribbon is unwound; and a deflection element fastened to the bracket and positioned at a distance from the braiding spool in a radial direction, wherein the deflection element is configured to deflect the film layer from the braiding spool to the additional spool.

16. The braiding bobbin according to claim 15 wherein:

the deflection element extends in an axial direction from a first deflection element end to a second deflection element end;

the first deflection element end is situated radially outward from the braiding spool; and the second deflection element end is situated radially outward from the additional spool.

17. The braiding bobbin according to claim 15 wherein an upper end of the braiding spool is directly joined with a lower end of the additional spool.

* * * * *